United States Patent [19]

Chernack et al.

[11] 4,158,902

[45] Jun. 26, 1979

[54] INTEGRAL SNAP ACTION HINGE

[76] Inventors: Milton P. Chernack, 399 June Pl., West Hempstead, N.Y. 11552; Armand A. Fiorenza, 2892 Carlyle Rd., Wantagh, N.Y. 11793

[21] Appl. No.: 838,113

[22] Filed: Sep. 30, 1977

[51] Int. Cl.[2] ..... E05D 7/00; E05D 1/02

[52] U.S. Cl. ..... 16/150; 16/128 R; 16/DIG. 13; 220/335; 220/339; 222/498; 222/517

[58] Field of Search ..... 16/150, 128 R, DIG. 13; 220/334, 339, 335; 222/498, 517

[56] References Cited

U.S. PATENT DOCUMENTS

| | | | |
|---|---|---|---|
| 2,690,861 | 10/1954 | Tupper | 16/150 UX |
| 3,295,726 | 1/1967 | Hanson | 220/334 X |
| 3,741,447 | 6/1973 | Miles et al. | 222/498 X |
| 3,752,371 | 8/1973 | Susuki et al. | 222/517 X |
| 3,842,463 | 10/1974 | Wehner | 16/DIG. 13 |
| 4,010,875 | 3/1977 | Babiol | 222/517 |

FOREIGN PATENT DOCUMENTS

| | | | |
|---|---|---|---|
| 677760 | 1/1964 | Canada | 220/339 |
| 1056999 | 2/1967 | United Kingdom | 16/DIG. 13 |
| 1180411 | 2/1970 | United Kingdom | 16/150 |

*Primary Examiner*—James Kee Chi

*Attorney, Agent, or Firm*—Hubbell, Cohen, Stiefel & Gross

[57] ABSTRACT

An improved integral snap action hinge comprises first and second main parts joined together by a plurality of hinge straps each of which includes a flexible intermediate portion which portions are aligned to define a hinge line which accommodates opening and closing of the hinge. Improved hinge also includes first and second hinge members, at least one of which is comprised of a flexible, resilient material. The first hinge member extends upward from the first main part between two of the hinge straps. The second hinge member extends upward from the second main part between the same two hinge straps, and confronts the first hinge member when the hinge is in the open position. The hinge members are so spaced that when the hinge is moved to the closed position the terminus of the first hinge member engages and slides along the confronting surface of the second hinge member, the sliding movement being accommodated by the flexing of the at least one flexible, resilient hinge member until the first hinge member is moved through a position substantially normal to the second hinge member whereupon the resiliency of the at least one hinge member acts to snap the hinge to the closed position.

9 Claims, 12 Drawing Figures

INTEGRAL SNAP ACTION HINGE

BACKGROUND OF THE INVENTION

1. Field of the Invention

This invention pertains generally to hinges and more particularly to integral hinges of the snap action variety.

2. Prior Art

Snap action hinges in which a first member is movable into confronting relation with a second member are well known. For example, U.S. Pat. No. 3,289,877 issued to Wolfe and U.S. Pat. No. 3,720,979 issued to Krawagna both disclose snap action type hinges in which the hinge tends to hold itself in both the open and closed positions. Thus, FIGS. 5-9 of both Wolfe and Krawagna disclose a hinge having two members which are connected at their confronting edges by two arms extending therebetween. At some intermediate point the arms are thinned to provide a flexible web which accommodates movement of the hinge between the open and closed positions. Each of the members also has a portion which protrudes upwardly from between the arms, which portions are joined together along a second flexible web that is vertically spaced from the first web. The biasing forces acting at the second web tend to hold the hinge in the closed position once the members have been rotated through a point of unstable equilibrium with respect to each other. Similarly, these biasing forces tend to hold the hinge in the open position once the members have moved past the same point in the other direction. The disadvantage of both these hinges, however, is that the hinge members are joined together through two separate web portions. Thus, proper registration of the two hinge members upon closing is dependent upon the first and second web portions being properly aligned. Further, since the upstanding members which provide the biasing effect are connected together through a relatively thin juncture, which juncture is subjected to high stress each time the hinge is moved through the point of unstable equilibrium, these hinges are prone to failure with prolonged use.

U.S. Pat. No. 3,618,161 issued to Nozawa discloses another type of snap action hinge mechanism. In this hinge, however, the snap action is provided by rounded leg pieces as they slide along a flat surface through a point of unstable equilibrium. This hinge mechanism is impractical because it requires that the hinged object or the hinge itself be provided with a flat, rigid surface to accommodate sliding of the leg pieces. Moreover, movement of Nozawa's hinge between the open and closed positions is accompanied by vertical movement of the thin hinge axis through which the hinge members are joined. With prolonged use this may lead to hinge failure as well as difficulty in registering the leaves upon closing.

Other exemplary snap action hinges are disclosed in U.S. Pat. Nos. 3,512,227, 3,516,115, 3,594,852 and 3,676,896. None of these patents, however, disclose a snap action type hinge which avoids the disadvantages noted above.

SUMMARY OF THE INVENTION

In accordance with the present invention we have developed an integral snap action hinge in which the snap action is provided by the interaction of two non-joined members.

The hinge includes first and second main parts joined together by a plurality of hinge straps, preferably two, each of which has a thin intermediate portion comprised of a flexible material. The intermediate portions are aligned and taken together define a hinge line which accommodates relative movement of the main parts between an open position in which one surface of the first main part is exposed and a closed position in which one surface of the second main part confronts said one first main part surface. A first hinge member extends upward from the first main part between two of the hinge straps and is confronted by a second hinge member which extends upward between the two straps from the second main part. At least one of the hinge members is comprised of a flexible, resilient material.

The hinge members are so spaced that as the hinge is moved to the closed position the terminus of the first hinge member, which is preferably rounded, engages and slides along the confronting surface of the second hinge member, the sliding movement being accommodated by the flexing of said at least one flexible, resilient hinge member. As the first hinge member moves through a position substantially normal to the second hinge member, the stress between the hinge members begins to decrease whereupon the resiliency of said at least one hinge member acts to snap the main parts to the closed position. These steps are reversed when the hinge is opened.

Because the hinge members are joined only to their respective main parts and not to each other, the possibility of hinge failure at the snap-action juncture is minimized. Further, since the intermediate portions of the hinge straps define a single axis which remains stationary as the main parts move between the open and closed positions, continuous registration of the hinge with prolonged use is enhanced.

By providing an upward extending stud in one of the main parts and an aperture in the other, which aperture is registrable with the stud when the hinge is closed, the hinge may serve as a reusable bottle cap. In this embodiment, means are also provided for securing the apertured portion to the neck of the bottle whereby the aperture will communicate with the bottle opening.

The preferred embodiment also includes means for firmly securing the main parts together once the hinge has been closed.

Further features, advantages and modifications of the integral hinge in accordance with the present invention will become apparent from the following detailed description and annexed drawings of the preferred embodiments thereof.

DETAILED DESCRIPTION OF THE PREFERRED EMBODIMENTS

Figure 1:
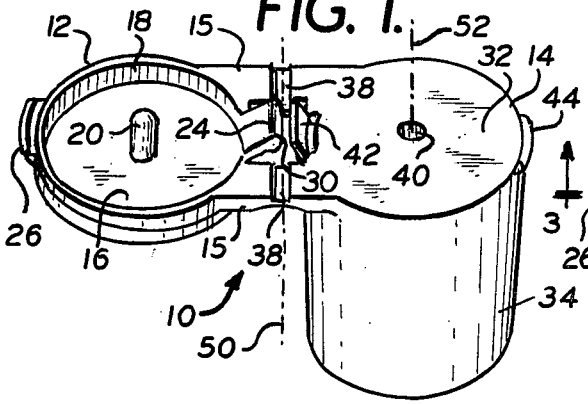
FIG. 1 is a perspective view of a reusable bottle cap incorporating the hinge of the present invention wherein the hinge is shown in the open position.
Figure 2:
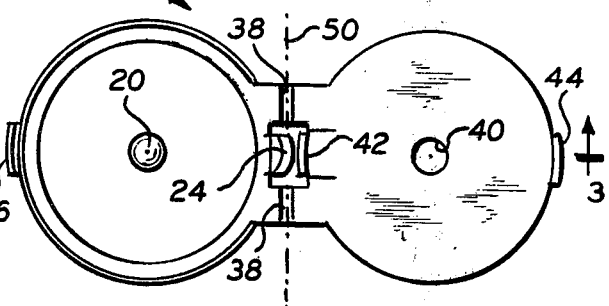
FIG. 2 is a top plan view of the cap shown in FIG. 1.

Referring now to the drawings in detail and particularly to FIGS. 1–7, the hinge of the present invention is shown as a part of a reusable cap 10 for a bottle 46. Of course, other applications for such a hinge, some of which will be discussed hereinafter, will be readily apparent to those skilled in the art. As illustrated, the cap 10 includes a cover member 12, a base member 14, a pair of hinge straps 15, and a pair of hinge members 24, 42.

The hinge according to the present invention is preferably a one piece integral structure comprised of a suitable flexible resilient material. Preferably, polypropylene is employed. Polypropylene has a highly crystalline structure which gives it a high tensile strength and the ability to remain flexible and resilient even at low temperatures. Further, polypropylene has the ability to withstand continued flexing without breakage as well as the ability to return to its original position after repeated bending operations.

Of course, any other moldable flexible synthetic material having the ability to withstand continued flexing without breaking, such as, for example, nylon, may also be employed.

Figure 3:
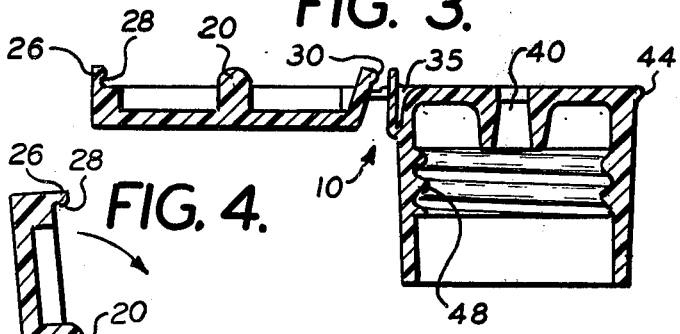
FIG. 3 is a view in vertical section taken along the line 3—3 in FIG. 2.
Figure 6:
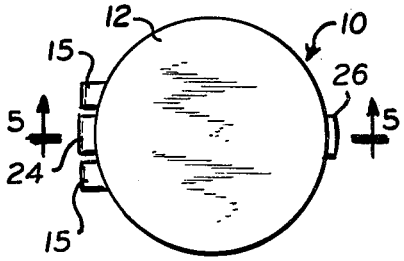
FIG. 6 is a top plan view of the cap in the closed position.

As shown, cover member 12 comprises a first disc-shaped member 16, a sidewall 18 which extends, as viewed in FIGS. 1 and 3, upward from the circumference of the disc 16, and a stud 20 which protrudes upward from the center of the disc. A first hinge member 24 in the shape of a tap extends upward from the portion of sidewall 18 nearest base member 14 when the hinge 15 is open, as viewed in FIGS. 1 and 3, and while tab 24 may, as does sidewall 18, extend perpendicularly upward from the disc 16, as presently preferred and shown tab 24 is angled slightly toward the member 14. Preferably, the terminus of tab 24 is rounded as shown at 30 for reasons that will be more fully apparent hereinafter. A second tab 26 extends upward from the sidewall 18 opposite tab 24. As is best shown in FIGS. 3 and 4, the lower portion of the tab 26 is indented at 28 for reasons that will be more fully explained hereinafter.

The base 14 comprises a second disc-shaped member 32, a sidewall 34 which extends downward from the circumference of the disc 32 as viewed in FIGS. 1 and 3, and an opening 40 desirable at the center of the disc for permitting material in a bottle 46 to flow out therethrough and proportioned to snugly receive the stud 20 when the cap 10 is in the closed position. A second hinge member 42 also preferably in the shape of a tab extends upward from the disc 32 opposite tab 24. As is best shown in FIGS. 3 and 4, the portion of tab 42 beneath the upper surface of disc 32 is spaced from sidewall 34 except at its point of juncture with said sidewall. The space between tab 42 and sidewall 34 defines a recess 35. Member 14 also includes a ridge 44 which extends outward from sidewall 34 opposite tab 42. When the cap is moved to the closed position, tab 26 may be forced over the ridge 44 whereby to securely seat the ridge in the recess 28 thereby firmly holding cap 10 in the closed position.

Cover 12 is joined to base 14 by hinge straps 15 which extend in spaced parallel relation between sidewalls 18, 34 on both sides of the tabs 24 and 42. As shown, each of the straps 15 includes a central portion 38 of reduced thickness which portions are aligned to define a hinge line 50 about which cover 12 may be rotated to accommodate opening and closing of the cap 10.

Figure 4:
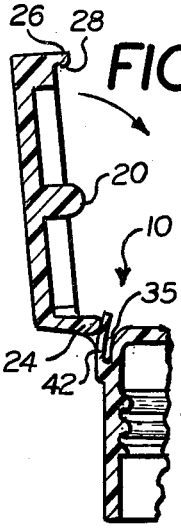
FIG. 4 is a fragmentary sectional view similar to FIG. 3 but showing the hinge in an intermediate position.
Figure 7:
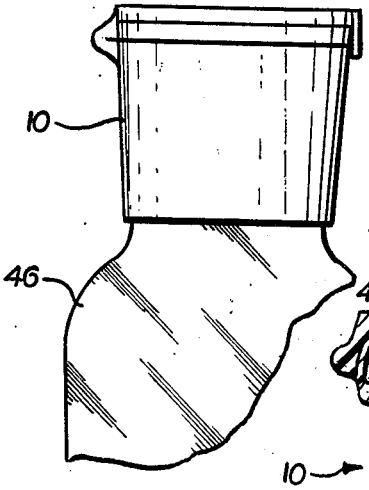
FIG. 7 is a view in side elevation showing the closed cap secured to a bottle.
Figure 5:
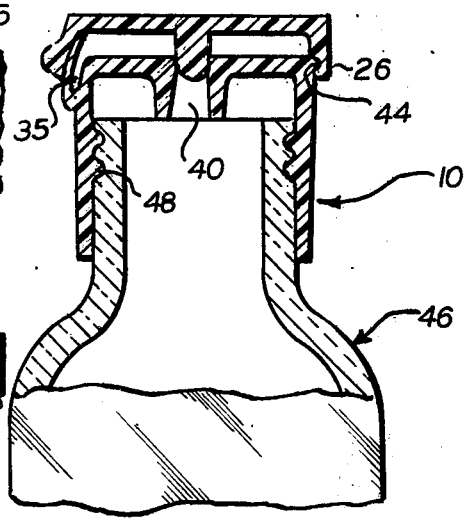
FIG. 5 is a sectional view similar to FIG. 3 but showing the cap in the closed position and also showing the cap secured to a bottle.

Referring now in particular to FIGS. 3–5, the interior surface of sidewall 34 may be threaded as shown at 48 whereby the cap 10 may be secured to the neck of bottle 46 which is also threaded. In the event the bottle neck is not threaded, the disc 32 may be so dimensioned that the interior surface of sidewall 34 may be force-fitted about the outside surface of the bottle neck. Thus it will be apparent that the particular dimensions and shape of the member 14 are dependent upon the particular application in which the hinge is to be employed. Similarly, while the shape of the member 12 is illustrated as being complementary to that of member 14 whereby when the cap 10 is in the closed position the inner surface of sidewall 18 will be in close engagement with the outer surface of sidewall 34, it will be immediately appreciated that the particular dimensions of the member 12 will also be dependent upon the particular application in which the hinge is employed.

Starting with the hinge in the open position, (FIG. 3) closing is accomplished by applying sufficient pressure to the member 12 to cause flexing of the portions 38, whereby member 12 is pivoted about axis 50 until the rounded portion 30 of tab 24 engages the facing surface of the tab 42, which, being thinner than tab 24, begins to flex. This flexing is accommodated by recess 35.

As rotation of member 12 about axis 50 is continued, the tab 24 eventually assumes a position normal to tab 42 at which point the stress imparted to tab 42 by the tab 24 is maximized (FIG. 4). Thereafter, the reduced stress on the tab 42, coupled with its resiliency, act to snap the hinge to the closed position wherein the outer surface of tab 42 engages the inner surface of tab 24. Movement of cover member 12 is then continued until the cover is moved to the position best illustrated in FIG. 5 wherein ridge 44 is firmly seated in recess 28 of the tab 26 and the stud 20 is received in opening 40. Clearly, sealing of opening 40 by the stud 20 effectively seals the bottle 46.

Due to the spacing between tab 24 and tab 42, tab 24 biases tab 42 towards the recess 35 when the member 12 is in the closed position. This results in tab 42 continuously exerting a force on the inner surface of the tab 24 which tends to move member 12 to the left in FIG. 5 thus insuring that the ridge 44 remains firmly seated in the recess 28. However, this is not absolutely necessary since it has been found that ridge 44 remains seated in recess 28 even if the tabs 24, 42 are spaced so as not to be in touching relation when the cap is closed. Moreover, the friction fit between stud 20 and the wall defined by opening 40 further serves to secure the cap in the closed position.

It will be apparent that in order to seal the bottle 46 the stud 20 must be exactly aligned with the opening 40 and must be of such dimension that the stud will be received with close tolerance in the opening. This requires that exact registration of the members 12, 14 occur each time the cap 10 is closed. The hinge assembly of the present invention is particularly adapted to insure such exact registration because the member 12 is moved to the closed position by rotation about a fixed axis 50. With reference to FIG. 1, this reduces the possibility that stud 20 will contact disc 32 either to the right or the left of opening 40. Further, because portions 38 extend transversely through the hinge straps 15, lateral motion of the straps is negligible, thus reducing the possibility of stud 20 striking disc 32 above or below opening 40 in FIG. 1. This latter effect is enhanced by keeping intermediate portions 38 as narrow as possible.

A further important advantage of the hinge of the present invention is that the snap action results from the interaction of two unjoined members, namely the tabs 24 and 42. This design provides increased structural integrity over those prior art snap action hinges wherein the members which provide the snap action are joined together by a thin web. Consequently the frequency of hinge failure is reduced.

With reference again to FIGS. 3–5, to open the cap 10 the user simply applies sufficient upward finger pressure on the tab 26 to unseat ridge 44 from recess 28. As the user continually applies upward pressure to the member 12, the tab 24 will again pass through a position normal to the tab 42. Thereafter, the reduced stress on the tab 42 coupled with the resiliency of the tab 42 and intermediate portions 38, act to snap the hinge to the open position wherein the outer surface of the tab 42 confronts the outer surface of the tab 24 (FIG. 3).

Skilled art workers will immediately recognize that a variety of modifications and variations of the cap 10 illustrated in FIGS. 1–7 and described above may be made without departing from the spirit and scope of this invention. For example, while the tab 42 is depicted in the drawings as being thinner than the tab 24, this is not necessary. Thus, tab 24 may be thinner or of the same thickness of the tab 42. All that is required is that one of the tabs be flexible and resilient. In the event tab 24 is made thinner than the tab 42, the tab 24, rather than the tab 42, will flex during opening and closing of the cap 10. It is also possible to eliminate recess 35 without interfering with the operability of the hinge.

Further, when the cap 10 is in the closed position, the tab 42, as shown in FIG. 5, is pressed against the inside surface of the tab 24. This too is not essential and it is possible to design a hinge in accordance with the present invention in which the inner surface of tab 24 and outer surface of tab 42 will be in spaced relation when the cap 10 is in the closed position.

Figure 11:
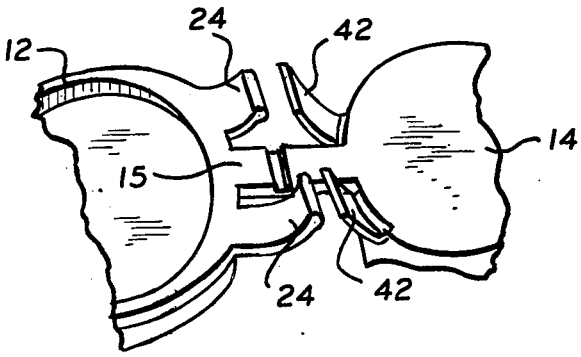
FIG. 11 is a fragmentary perspective view of a bottle cap showing a still further modification of the hinge of the present invention.

Also, the functions of the tabs 24 and 42 may be reversed; that is, the hinge may be designed such that the terminus of the tab 42 will slide along the outer surface of the tab 24 during opening and closing of the hinge. In such case the rounded portion 30 at the end of the tab 24 may be eliminated and a rounded portion added on the end of the tab 42. Furthermore, while the preferred hinge has been shown as including two hinge straps, more than two such straps may be employed. For example, if the particular application calls for a rather wide integral hinge, several hinge straps may be employed. If this is done, the tabs 24 and 42 may be disposed between each pair of juxtaposed straps, or just between one pair. As illustrated in FIG. 11, a still further possibility comprises the use of a single hinge strap 15 with a tab pair 24, 42 disposed on either side of the strap.

Figure 8:
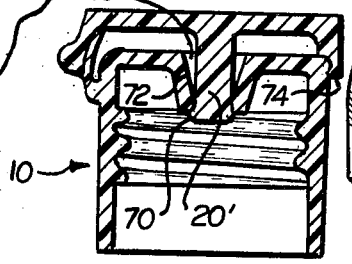
FIG. 8 is a view in vertical section showing an alternative embodiment of the cap in the closed position.

It will also be apparent that means other than tab 26 and ridge 44 may be devised for securing members 12 and 14 in the closed position. For example, with reference to FIG. 8, one such alternative embodiment is shown.

In this embodiment the stud 20' is elongated and has a radially outwardly extending lip 70 at the free end thereof. The stud 20' is made long enough to protrude entirely through the cylinder 72 which defines the opening 40'. Preferably, lip 70 is relatively thin and is comprised of polypropylene as is the remainder of cap 10. In this embodiment, opening 40' is preferably tapered outward from bottom to top as shown.

As the member 12 is moved to the closed position, the lip 70 is flexed upward by the interior sidewalls of the cylinder 72. Once the cap 10 is in the fully closed position, the lip 70 protrudes beyond the bottom of the cylinder 72. Thus, the resilient forces imparted to member 12 by intermediate portions 38 and tab 42 are opposed by the restraining force applied to the upper surface of the lip 70 by the annulus which defines the bottom of the cylinder 72. When it is desired to open the cap 10, the user simply applies sufficient upward pressure to the member 12 to flex the lip 70 downward whereby the outer radius of the lip 70 will be sufficiently reduced to permit the stud 20' to be pulled through the opening 40' in the manner more fully described above. When this arrangement is employed, the tab 26 may be replaced by a bead 74 on sidewall 18 which provides a convenient point for the user to apply finger pressure to member 12 to permit opening of cap 10.

Figure 9:
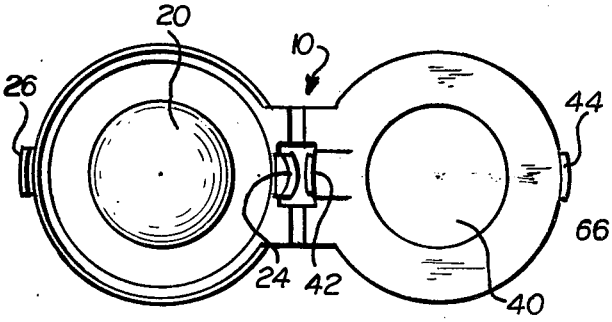
FIG. 9 is a view similar to FIG. 2 but showing still another embodiment of a cap incorporating the hinge of the present invention.
Figure 10:
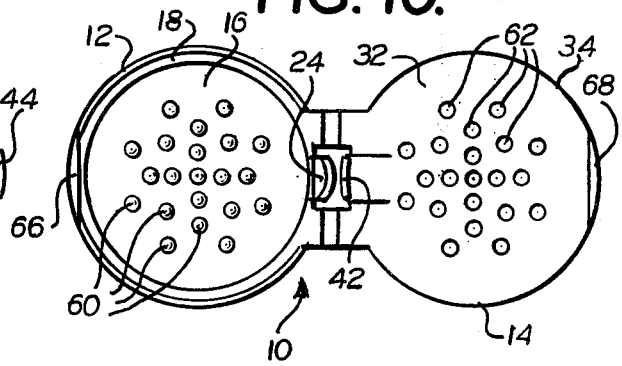
FIG. 10 is a view similar to FIG. 9 showing still yet another modification of a cap incorporating the hinge of the present invention.

Other applications of the present invention are illustrated in FIGS. 9 and 10. FIG. 9 shows a self-hinged snap cap quite similar to that illustrated in FIG. 1 except that stud 20 and opening 40 are much larger in order that cap 10 may serve as a cap for a pouring bottle, such as, for example, a soda bottle. Likewise, FIG. 10 shows a self-hinged snap cap quite similar to FIG. 1 except stud 20 has been replaced by a plurality of studs 60 which are receivable in a plurality of openings 62 in the disc 32. In this embodiment the cap 10 is particularly suited for use as a cap for a salt or pepper shaker, for example. FIG. 10 also illustrates a still further approach to securing member 12 to member 14 when the cap 10 is closed. Thus, tab 26 and ridge 44 of FIGS. 1–7 are replaced by a lip 66 and a receiving recess 68, respectively. Lip 66 is provided by cutting away the interior portion of the sidewall 18 opposite the tab 24. The shape of recess 68 is complementary to that of the lip 66, the recess being provided by cutting away an exterior portion of the sidewall 34 opposite the tab 42 and adjacent the upper surface of the disc 32. When this embodiment is employed, the tab 42 should exert sufficient force on tab 24 when the cap 10 is closed such that lip 66 will be held firmly against the wall defining the recess 68. This will prevent the forces imparted to member 12 by the resiliency of the portions 38 from unseating lip 66 from recess 68 thus avoiding undesired opening of cap 10.

Figure 12:
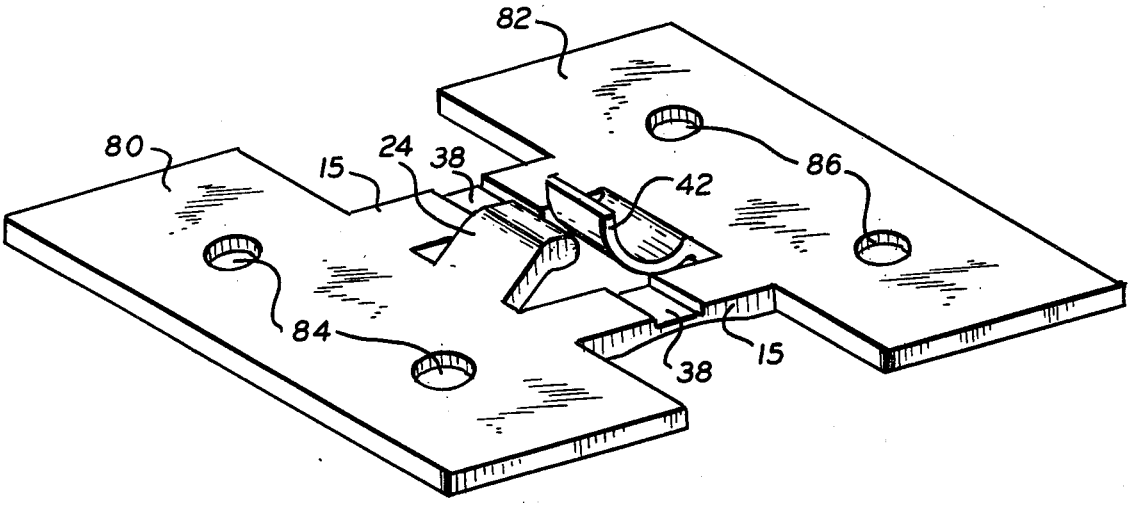
FIG. 12 is a perspective view of a paper holder incorporating the hinge of the present invention.

Referring now to FIG. 12, another embodiment of a hinge in accordance with the present invention is shown. In FIG. 12 the cover and base members are depicted as rectangular planar members 80 and 82. As shown, each of the members 80, 82 has a pair of holes 84, 86 respectively, which hole pairs are registered when the hinge is moved to the closed position. This particular embodiment is suitable for use as a paper holder in which case the paper would be provided with a pair of holes registrable with the hole pairs 84, 86. Then with the hinge in the closed position and the paper inserted between the plates 80,82, a suitable member or members (not shown) could be inserted through the hole pairs 84, 86 to hold the hinge in the closed position and firmly clamp the paper between the plates.

Still other applications of the hinge in accordance with the present invention will be apparent to those skilled in the art. Thus, while we have herein shown and described the preferred embodiments of the present invention and have indicated a number of modifications and variations which may be made therein, still other changes may be made without departing from the spirit and scope of the invention as defined by the claims. Therefore, the above description is to be construed as illustrative and not in the limiting sense.

What is claimed is:

1. An integral snap action hinge of the type including a first main part; a second main part; and a plurality of hinge straps extending between confronting edge portions of said first and second main parts for joining said parts together, each of said hinge straps having a flexible intermediate portion which portions are aligned to define a hinge line for permitting relative pivotal movement of said first and second parts between an open position in which one surface of said first part is exposed and a closed position in which one surface of said second part is in confronting relation with said one surface of said first part, the improvement comprising:

a first hinge member extending out of the plane of said one surface of said first main part at an angle thereto, said member being disposed at said confronting edge portion of said first main part between two of said plurality of hinge straps with one surface of said member confronting said second main part when said hinge is in said open position; and a second hinge member extending out of the plane of said one surface of said second main part at another angle thereto, said second hinge member being disposed at said confronting edge portion of said second main part between said two straps with one surface of said second hinge member in spaced confronting relation with said one surface of said first hinge member when said hinge is in said open position, at least one of said hinge members being comprised of a flexible resilient material, the terminus of said first hinge member being spaced from said one surface of said second hinge member for engaging said one surface of said second hinge member and sliding therealong as said hinge is moved to said closed position, said sliding movement being accommodated by the flexing of said at least one hinge member until said terminus is moved through a position substantially normal to said one surface of said second hinge member whereupon the resiliency of said at least one hinge member effects a force on said main parts having a line of action spaced from said hinge line, the moment of said force about said hinge line biasing said first and second main parts to said closed position.

2. A hinge according to claim 1, wherein said hinge straps are comprised of polypropylene and wherein said hinge strap flexible intermediate portions are defined by transverse portions of reduced thickness as compared with the remainder of said hinge straps.

3. A hinge according to claim 2, wherein said first and second hinge members comprise first and second tabs, respectively; said second tab extends out of the plane of said one surface of said second main part at a right angle; said first tab is angled toward said second tab when said first and second main parts are in said open position; and the terminus of said first tab is rounded to facilitate said sliding movement.

4. A hinge according to claim 3, wherein said second main part has at least one aperture therein, and further comprising means for securing said second main part to a bottle neck defining an orifice with said aperture in communication with said orifice; and at least one stud protruding upwardly from said one surface of said first main part, said stud being receivable within said aperture when said main parts are in said closed position.

5. A hinge according to claim 4, wherein said means for securing said second main part to said bottle neck comprises a circumferential sidewall integral with said second main part and extending perpendicularly out of the plane defined by the surface of said second main part opposite said one surface thereof; and said at least one tab is said second tab, the lower portion of said second tab being secured to said sidewall below said one surface of said second main part, the upper portion of said second tab being spaced from said sidewall to define a recess between said second tab and said sidewall for accommodating flexing of said second tab when said first and second main parts are moved to said closed position.

6. A hinge according to claim 5, and further comprising means for releasably securing said first and second main parts together when said main parts are in said closed position.

7. A hinge according to claim 6, wherein said means for releasably securing said first and second main parts in said closed position comprises a rib extending out of the plane of said one surface of said first main part, said rib being located on said first main part opposite said first tab, the face of said rib confronting said first tab having a recess adjacent said one surface of said first main part; and a third tab extending out of the plane of said one surface of said second main part, said third tab being located on said second main part opposite said second tab and dimensioned for snap fitting in said recess when said main parts are in said closed position.

8. A hinge according to claim 6, wherein the terminus of said stud protrudes through said aperture when said hinge is in said closed position, and wherein said means for releasably securing said first and second main parts in said closed position comprises a flexible resilient flange extending radially outward from said stud terminus, said flange being of greater diameter than the diameter of said aperture whereby when said main parts are in said closed position said flange engages the surface of said second main part opposite said one surface thereof.

9. An integral snap action hinge of the type including a first main part; a second main part; and a hinge strap extending between confronting edge portions of said first and second main parts for joining said parts together, said hinge strap having a flexible intermediate portion which defines a hinge line for permitting relative pivotal movement of said first and second parts between an open position in which one surface of said first part is exposed and a closed position in which one surface of said second part is in confronting relation with said one surface of said first part, the improvement comprising:

a first pair of hinge members extending out of the plane of said one surface of said first main part at an angle thereto, said members being disposed at said confronting edge portion of said first main part on either side of said hinge strap with one surface of each of said members confronting said second main part when said hinge is in said open position; and a second pair of hinge members extending out of the plane of said one surface of said second main part at another angle thereto, said second hinge members being disposed at said confronting edge portion of said second main part on either said of said strap with a surface of each of said second hinge members in spaced confronting relation with the first hinge member opposite thereto when the hinge is in the open position, at least one of the hinge members in each pair being comprised of a flexible resilient material, the termini of said first pair of hinge members being spaced from said second hinge member surfaces for engaging same and sliding therealong as said hinge is moved to said closed position, said sliding movement being accommodated by the flexing of said flexible resilient hinge members until said termini are moved through a position substantially normal to said second hinge member surfaces whereupon the resiliency of said at least one hinge member in each pair effects a force on said main parts having a line of action spaced from said hinge line, the moment of said force about said hinge line biasing said first and second main parts to said closed position.

* * * * *